US011725639B2

(12) United States Patent
Kronpass

(10) Patent No.: US 11,725,639 B2
(45) Date of Patent: Aug. 15, 2023

(54) SWASH PLATE-TYPE AXIAL, PISTON PUMP

(71) Applicant: HYDAC DRIVE CENTER GMBH, Langenau (DE)

(72) Inventor: Manuel Kronpass, Tittling (DE)

(73) Assignee: HYDAC DRIVE CENTER GMBH, Langenau (DE)

( * ) Notice: Subject to any disclaimer, the term of this patent is extended or adjusted under 35 U.S.C. 154(b) by 276 days.

(21) Appl. No.: 17/047,773

(22) PCT Filed: Mar. 29, 2019

(86) PCT No.: PCT/EP2019/057982
§ 371 (c)(1),
(2) Date: Oct. 15, 2020

(87) PCT Pub. No.: WO2019/201574
PCT Pub. Date: Oct. 24, 2019

(65) Prior Publication Data

US 2021/0115909 A1 Apr. 22, 2021

(30) Foreign Application Priority Data

Apr. 19, 2018 (DE) ..... 10 2018 003 207.9

(51) Int. Cl.
*F04B 1/324* (2020.01)
*F04B 53/14* (2006.01)
*F04B 53/18* (2006.01)

(52) U.S. Cl.
CPC ..... *F04B 1/324* (2013.01); *F04B 53/14* (2013.01); *F04B 53/18* (2013.01)

(58) Field of Classification Search
CPC ..... F04B 1/324; F04B 53/14; F04B 53/18
(Continued)

(56) References Cited

U.S. PATENT DOCUMENTS 1,534,766 A * 4/1925 Briney ..... F16J 9/06 277/460
3,174,762 A * 3/1965 Hesling ..... F16J 9/22 277/447

(Continued)

FOREIGN PATENT DOCUMENTS

DE 32 32 363 3/1983
DE 3232363 A1 * 3/1983

(Continued)

OTHER PUBLICATIONS

English translation of DE 3232363 A1 obtained Sep. 14, 2022 (Year: 1983).*

(Continued)

*Primary Examiner* — Connor J Tremarche
(74) *Attorney, Agent, or Firm* — Wenderoth, Lind & Ponack, L.L.P.

(57) ABSTRACT

A swash plate-type axial piston pump, in particular for hydraulic systems, has a cylinder drum (3) rotatable about an axis of rotation (7) in a pump housing (1) and in which pistons (9) are arranged axially movable. The actuating ends of the pistons are accessible from outside of the cylinder drum (3) and are supported at least indirectly on a swash plate (15). In order to set the stroke of the pistons (9) and the fluid system pressure generated, the swash plate can be swiveled to the desired angle of inclination relative to the axis of rotation (7) by an adjustment device (21), which has at least one swiveling lever (23) that can be deflected and returned in at least one direction by an actuator and that each has in at least one hydraulically actuated actuating cylinder (31, 43) one actuating piston (35) acting on one end on an articulation point (29) of the swivel lever (23). One actuating piston (35, 47) has at its end, facing away from the articulation point (29), a guide surface (73), which is an integral part of the actuating piston (35, 47) and is in contact with an (Continued)

assigned guide surface (33, 45) of the actuating cylinder (31, 43). At least one compensator (75, 70, 59) is orients the guide surfaces (73; 33, 45) in their respective positions relative to each other.

23 Claims, 5 Drawing Sheets

(58) Field of Classification Search
USPC ..... 417/222.1
See application file for complete search history.

(56) References Cited

U.S. PATENT DOCUMENTS

| | | | | |
|---|---|---|---|---|
| 4,334,832 | A | 6/1982 | Brown et al. | |
| 2016/0237993 | A1* | 8/2016 | Bosch | C23C 24/106 |

FOREIGN PATENT DOCUMENTS

| | | |
|---|---|---|
| DE | 3 3 27 3 51 | 2/1985 |
| DE | 36 26 619 | 2/1988 |
| DE | 10 2012 218 971 | 4/2014 |
| DE | 10 2013 008 681 | 11/2014 |
| WO | 2014/187512 | 11/2014 |

OTHER PUBLICATIONS

International Search Report (ISR) dated Jun. 28, 2019 in International (PCT) Application No. PCT/EP2019/057982.

* cited by examiner

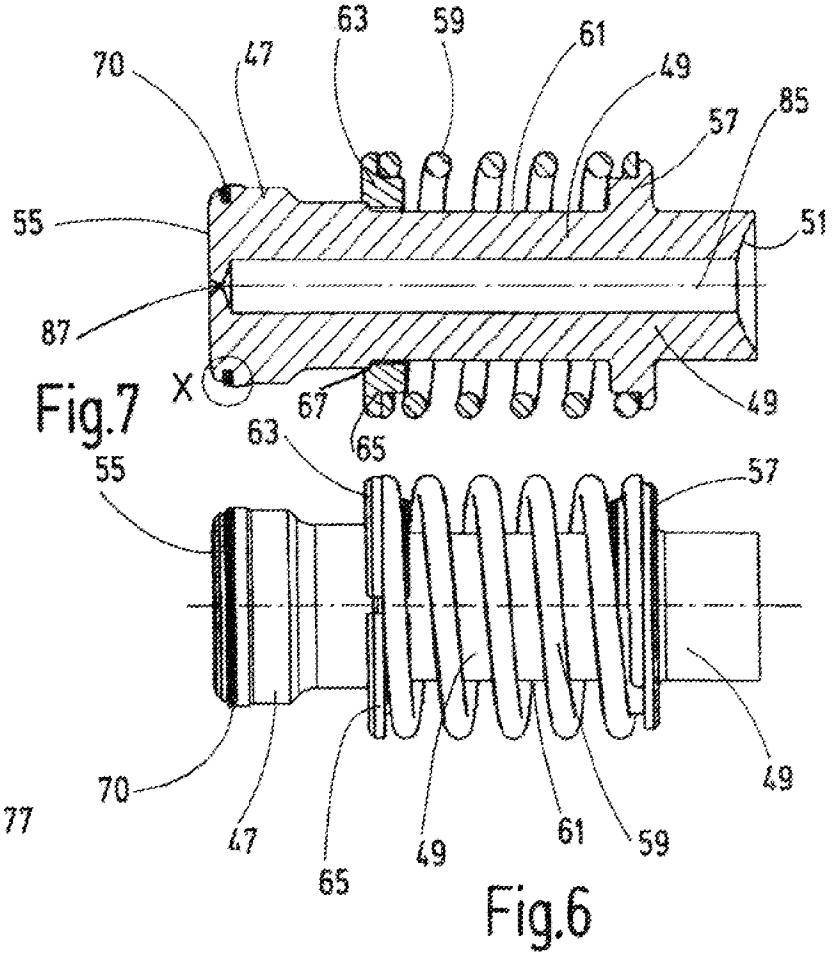
Fig.7
Fig.6
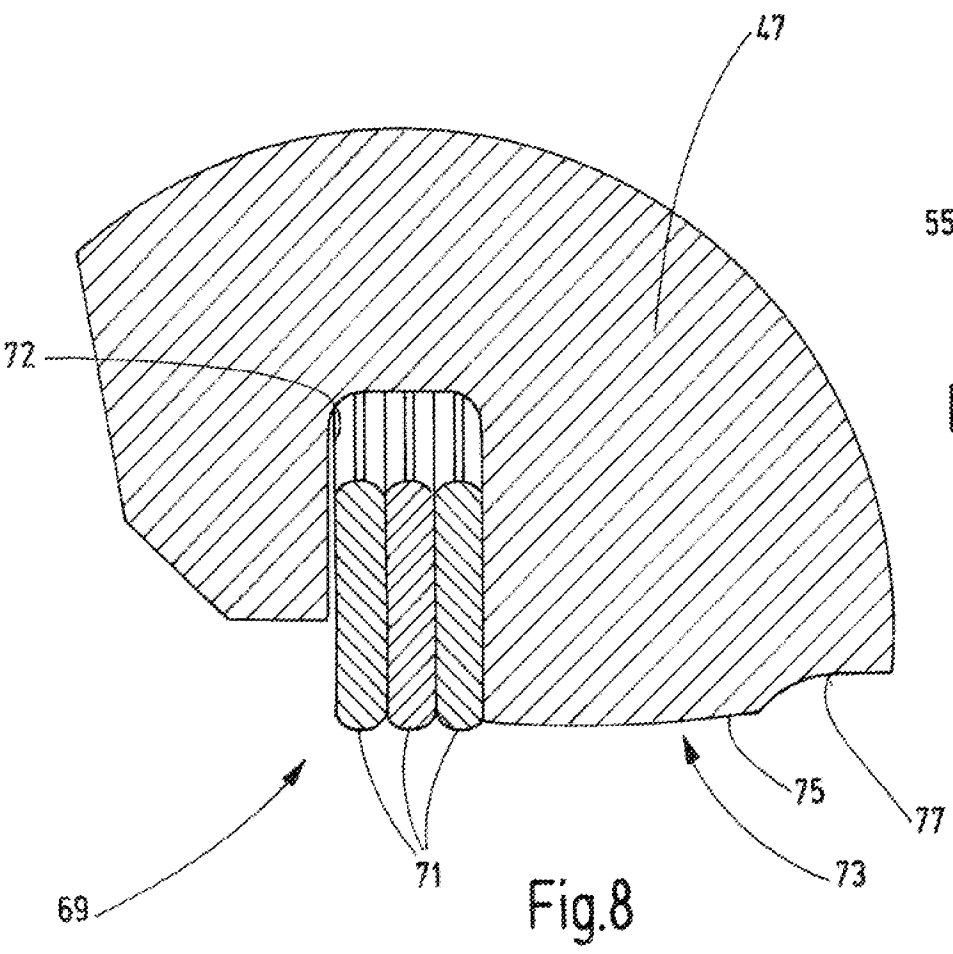
Fig.8

SWASH PLATE-TYPE AXIAL, PISTON PUMP

FIELD OF THE INVENTION

The invention relates to a swash plate-type axial piston pump, in particular for hydraulic systems, having a cylinder drum, which can be driven in rotation about an axis of rotation in a pump housing. Pistons are arranged in and are axially movable in the pump housing. The actuating ends of the pistons are accessible from outside of the cylinder drum and are supported at least indirectly on a swash plate. In order to set the stroke of the pistons, and thus, the fluid system pressure generated by these pistons, the swash plate can be swiveled to the desired angle of inclination relative to the axis of rotation by an adjustment device. The adjustment device has at least one swivel lever, which can be deflected and returned in at least one direction by an actuator and which has in at least one hydraulically actuated actuating cylinder, One actuating piston of the actuating cylinder acts on one end on an articulation point of the swivel lever.

BACKGROUND OF THE INVENTION

Swash plate-type axial piston pumps are state of the art. They are widely used for pressure media supply of loads such as working cylinders, hydraulic motors and the like. Axial piston pumps of the genus mentioned above, in which the inclination of a swash plate can be adjusted relative to the axis of rotation, are characterized by a better energy balance in operation in comparison to also known axial piston pumps having a fixed swash plate. Pumps having a fixed swash plate as fixed displacement pumps at a predefined drive speed always deliver a constant volume flow of fluid, even if no energy is requested from pressure-medium actuated units. At no-load, the flow resistances in the hydraulic circuit have to be overcome, for which purpose drive energy is spent, which does not deliver any useful energy. By the adjustability of the inclination of the swash plate, the delivery volume can be set to zero and the demand for drive energy can be minimized. An axial piston pump of the type mentioned above is disclosed in WO 2014/187512 A1. The production of the known axial piston pumps of this genus is expensive, because a considerable constructional effort is required for the adjustment device having the gearing connection, which converts the linear motion of the respective actuating piston of the at least one fixed actuating cylinder into a swivel motion of the swash plate.

SUMMARY OF THE INVENTION

In view of this problem, the invention addresses the object of providing an axial piston pump whose adjustment device for setting the angular position of the swash plate is characterized by a high degree of operational reliability at a comparatively simple structure.

According to the invention, this object is basically achieved by an axial piston pump having, as tan essential feature of the invention, at least one actuating piston having at its end, facing away from the articulation point, a guide surface, which is an integral part of the actuating piston and is in contact with an assigned guide surface of the actuating cylinder. At least one compensation means is provided, which compensation means orients the guide surfaces in their respective position relative to each other. The actuator can be implemented having only one single articulation point between the swivel lever and the actuating piston. The compensating device, provided according to the invention, effects a mutual positional alignment of piston-sided guide surfaces and cylinder-sided guide surfaces. In the mentioned known solution, a ball joint is formed between the piston and the piston rod of the actuating piston to keep the piston of the actuating cylinder free from constraining forces during adjustment movements. During adjustment movements, the swivel lever performs a swivel motion transverse to the cylinder axis of the actuating cylinder. Owing to the presence of the compensation means, this ball joint is omitted in the invention, so that the actuating piston and its piston rod can be integrally formed as a turned part. In addition to the resulting simplification and reduction in production costs, the elimination of the ball joint in the piston also reduces the friction forces and the hysteresis.

The compensation means can be formed at least partially by a spherical outer contour of at least one of the guide surfaces and/or a resiliently flexible sealing arrangement at the free end of at least one respective actuating piston and/or a compression spring arrangement and/or a lubricant supply.

In particularly advantageous embodiments, two actuating pistons are provided, both of which have at least one of the compensation means.

With particular advantage, the arrangement can be such that the free end face of one actuating piston is connected to a system pressure side, and the free end face of the other actuating piston is connected to a control pressure side, which are part of the actuating device for the adjustment device.

The lubricant supply can have a longitudinal channel through one of the actuating pistons, which is preferably assigned to the system pressure side. A further channel is in the articulation point of the swivel lever. Advantageously a throttle on the free end face of the actuating piston can form the inlet of the longitudinal channel.

For particularly advantageous embodiments, the respective actuating piston has, adjacent to its end face, a sealing zone, formed by at least one piston ring, and a guide zone adjoining thereto. The guide zone forms the one spherical guide surface, which, by resting against the guide surface of the actuating cylinder, forms the compensation means. A section of reduced diameter, forming the transition to the piston rod of the actuating piston, adjoins the guide zone.

In advantageous embodiments, the articulation point is formed by a ball joint having a ball head formed at the free end of the swivel lever and a ball socket formed on the respective actuating piston. The spring arrangement holds the ball head and the respective ball socket in force-fitted contact with each other. This structure allows the entire actuator to be formed free of play.

The arrangement can advantageously be made such that the spring arrangement simultaneously pre-loads the swash plate in the swivel position corresponding to maximum pump delivery. Due to this double function of the spring arrangement, the actuating cylinder does not have to be formed as a double-acting cylinder for the generation of actuating movements in both directions, but a single-acting actuating cylinder may be provided. The single-acting actuating cylinder only causes an actuating motion from the swivel position for maximum pump delivery to a lower delivery volume, down to zero delivery.

In particularly advantageous embodiments, the second actuating cylinder has a joint cylinder axis perpendicular to the axis of rotation and is arranged opposite from the first actuating cylinder. The actuating piston of the second actuating cylinder can be hydraulically moved in opposition to the motion of the piston of the first actuating cylinder. A second compensation means is formed between the second actuating cylinder and its piston rod by a guide zone, forming a spherical guide surface, of the piston of the second actuating cylinder. The end of the piston rod of the second actuating cylinder forms a second ball joint at the actuating part of the swash plate.

In a particularly advantageous manner, the spring arrangement may have a compression spring, which preloads the piston rod of the second actuating piston for the motion, corresponding to the extension of the actuating piston of the second actuating cylinder and the retraction of the actuating piston of the first actuating cylinder, and thus, to the swiveling of the swiveling lever from the direction parallel to the axis towards the position of maximum pump delivery.

With regard to the actuation of the adjustment device, the arrangement may be advantageously such that the first actuating cylinder is pressurized with a control pressure for adjusting the pump delivery and such that the second actuating cylinder is pressurized with the existing system pressure. In this way, the adjustment device is set to maximum delivery by the force of the compression spring, when there is no system pressure, i.e. when the pump is at a standstill. When operating the pump with the resulting system pressure, the setting to maximum delivery is maintained until the actuating force, generated by the control pressure in the first actuating cylinder, exceeds the piston force, generated by the system pressure in the second actuating cylinder plus the spring force. After that occurrence, depending on the control pressure, the swash plate is swiveled back to a lower delivery rate.

For an operation at a control pressure of limited pressure level, preferably the piston surface, which can be pressurized by the control pressure, of the piston of the first actuating cylinder is selected to be larger than the piston surface, which can be pressurized by the system pressure, of the piston of the second actuating cylinder.

Other objects, advantages and salient features of the present invention will become apparent from the following detailed description, which, taken in conjunction with the drawings, discloses a preferred embodiment of the present invention.

BRIEF DESCRIPTION OF THE DRAWINGS

Referring to the drawings that form a part of this disclosure:

FIG. 6 is a side view of the actuating piston on the of left-side of FIG. 5, of the exemplary embodiment according to the invention;

FIG. 7 is a side view in section of the actuating piston of FIG. 6;

FIG. 8 is a side view in section of the area marked X in FIG. 7 in a representation enlarged about 50 times compared to FIG. 7;

DETAILED DESCRIPTION OF THE INVENTION

Figure 2:
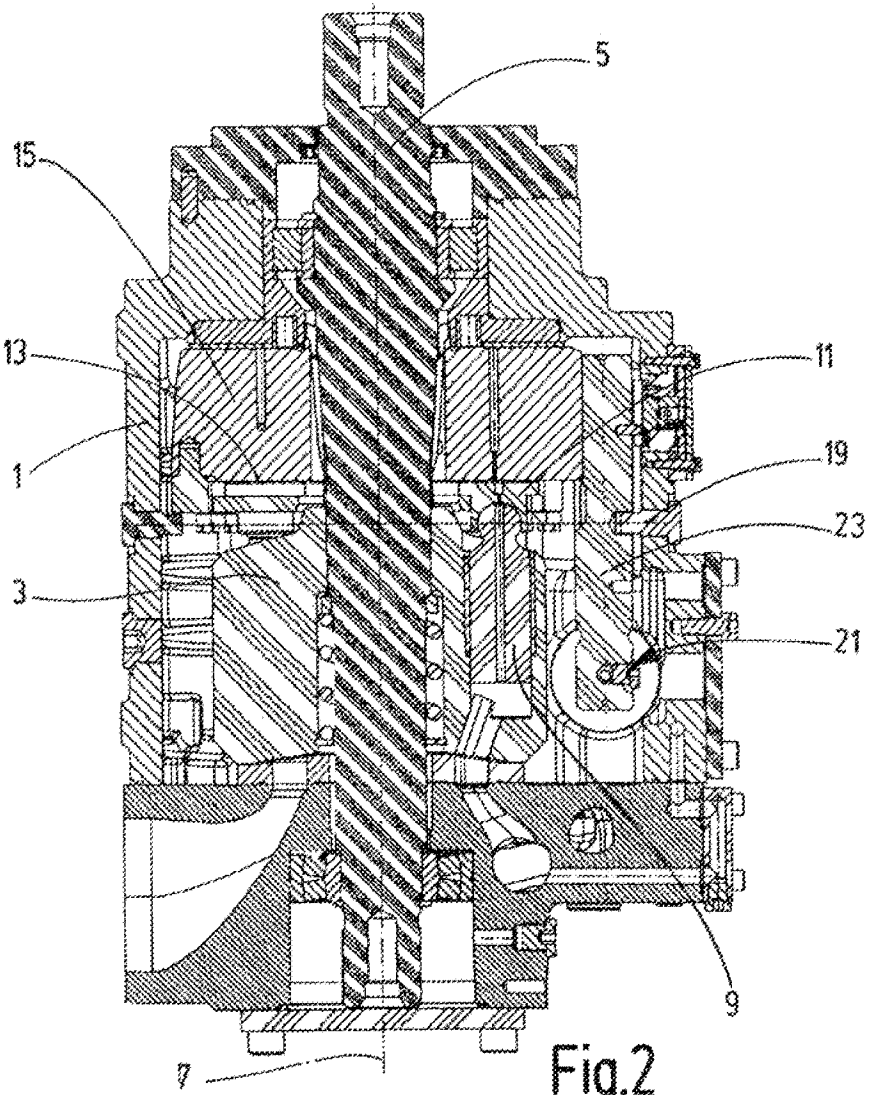
Fig.2 PRIOR ART
FIG. 2 is a side view in section of the axial piston pump, rotated by 90° in relation to FIG. 1, in accordance with the state of the art.
Figure 1:
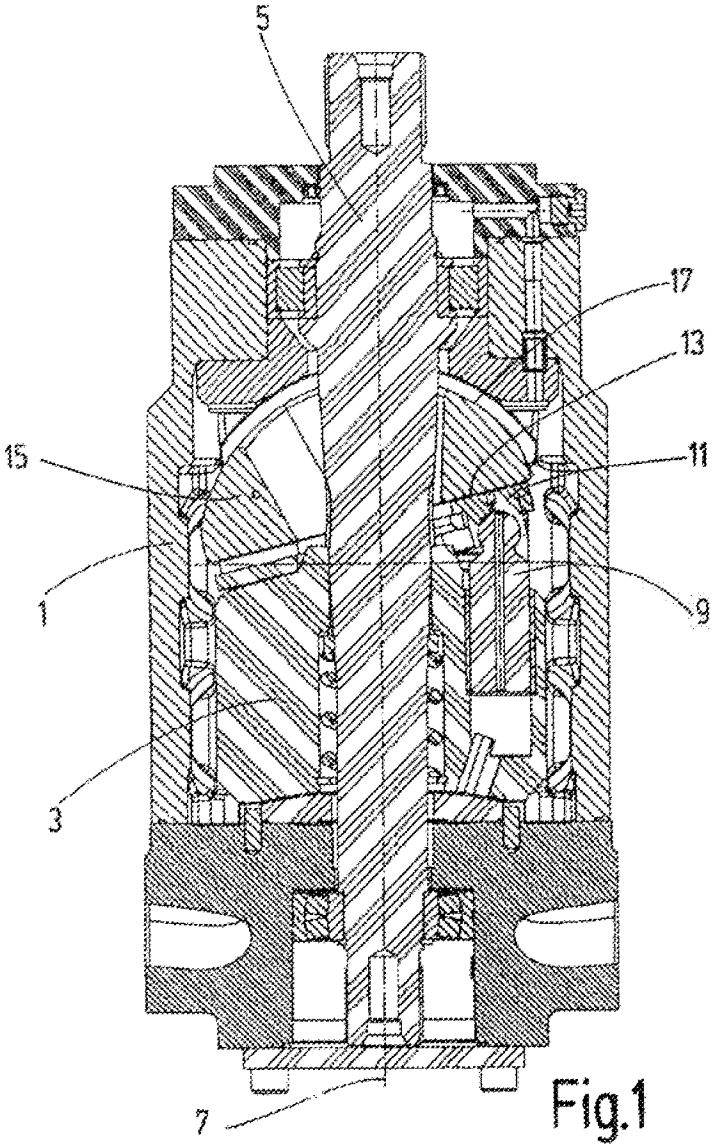
Fig.1 PRIOR ART
FIG. 1 is a side view in section of a swash-plate type axial piston pump according to the state of the art.

In the figures, FIGS. 1 and 2 show an axial piston pump in accordance with the state of the art, while FIGS. 3 to 10 show an exemplary embodiment of the invention. Inside a pump housing 1, a cylinder drum 3 can be rotated about an axis of rotation 7 by a drive shaft 5. As can best be seen in FIGS. 1 and 2, which show a state-of-the-art axial piston pump, axially movable pistons 9, located in the cylinder drum 3, are supported on the sliding surface 13 of a swash plate 15 by sliding shoes 11 located at the upper ends of the pistons 9. At the end, facing away from the sliding surface 13, the swash plate 15 is movably guided on the pump housing 1 via an circular arc-shaped swash-plate bearing 17 such that the swash plate 15 can be swiveled about a swivel axis. The swivel axis extends perpendicular to the axis of rotation 7 and extends in the plane of the sliding surface 13 of the swash plate 15, and thus, perpendicular to the drawing plane of FIGS. 1, 3 and 4. By an adjustment device 21, the swash plate 15 can be swiveled about this swivel axis between the swivel settings shown in FIGS. 1 and 4 corresponding to the maximum delivery rate of the pump, and the swivel settings shown in FIGS. 2, 3 and 5 corresponding to zero delivery. In this process, the plane of the sliding surface 13, in relation to the vertical course of the axis of rotation 7, the plane of the sliding surface is in the horizontal in the zero delivery swivel position, such that no stroke of the pistons 9 occurs during the rotation of the cylinder drum 3.

As the actuating part assigned to the swash plate 15, the adjustment device or adjustor 21 has a swivel lever 23, which is attached to the swash plate 15 and extends laterally of the swash plate 15 and the cylinder drum 3. A swivel pin 19 (see FIG. 2) is used to swivel mount the swivel lever 23 on the housing 1. The swivel lever 23 has an articulation point 29 at its lower free end, at which the actuators of the adjustment device 21 act in order to move the swivel lever 23 in the drawing plane of FIGS. 1 and 3 to 5, and thus, swivel the swash plate 15 about its swivel axis.

Figure 4:
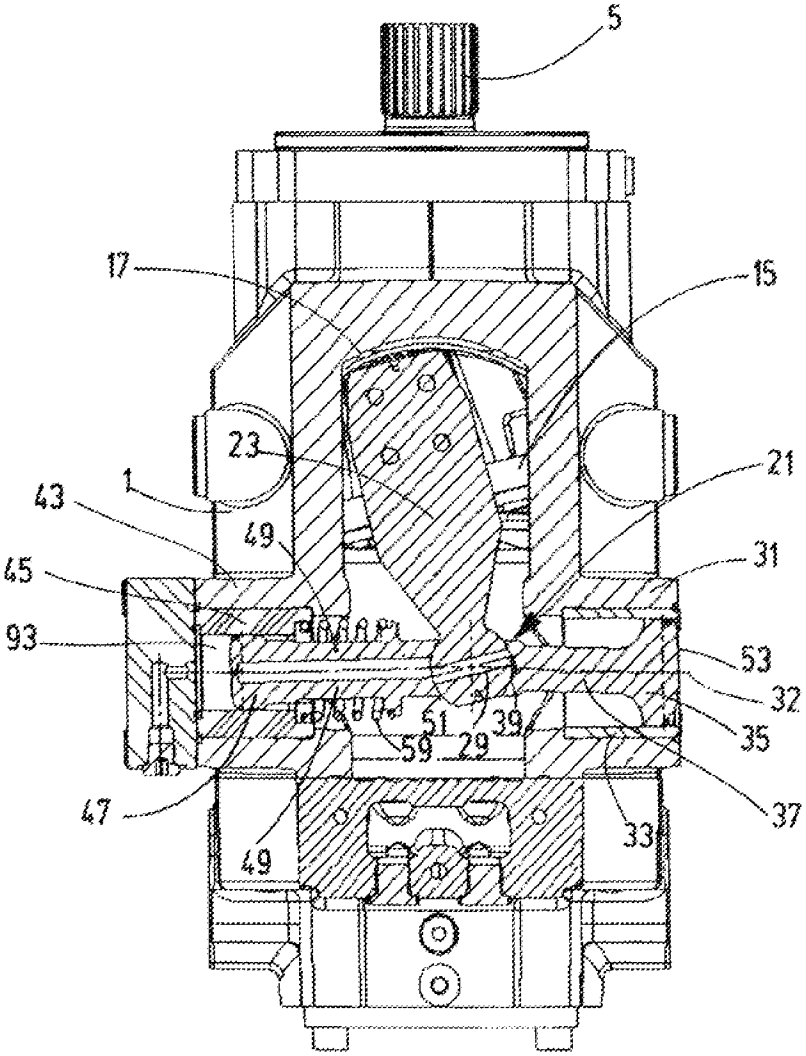
FIG. 4 is a side view in section of the axial piston pump of FIG. 3, wherein the adjustment device is shown in the operating state corresponding to maximum pump delivery.
Figure 3:
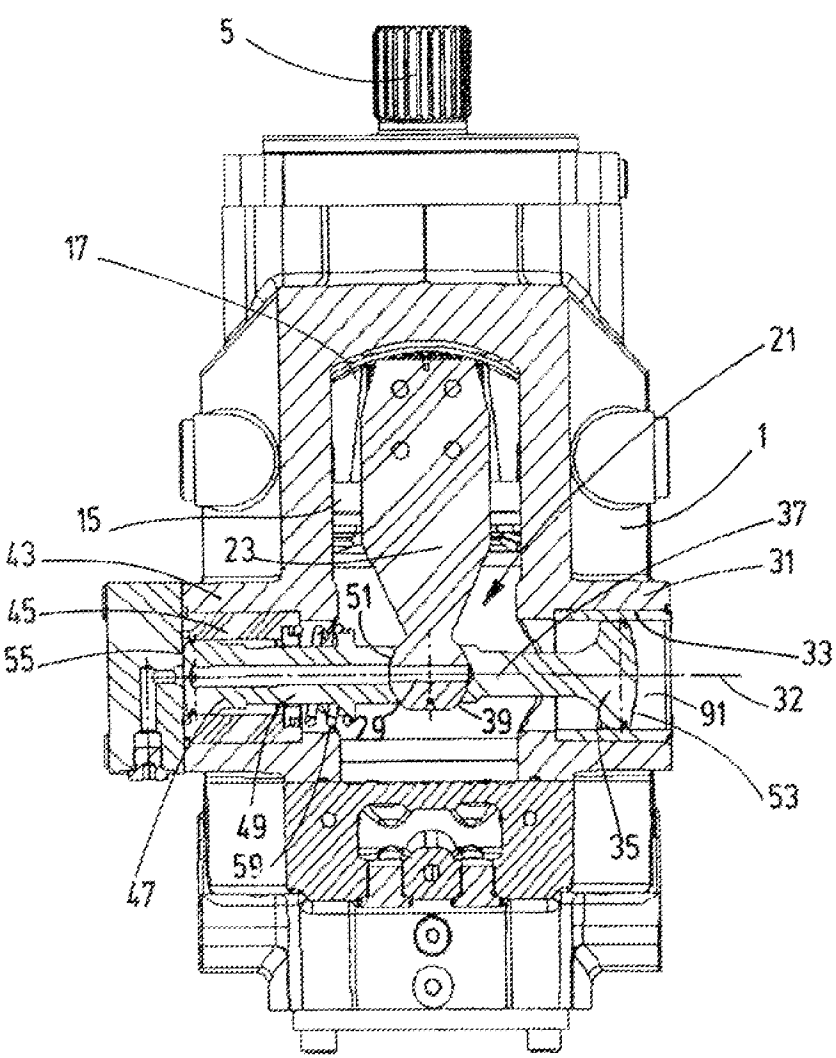
FIG. 3 is a side view of an axial piston pump according to an exemplary embodiment of the invention, wherein the adjustment device is shown in sectional view.
Figure 5:
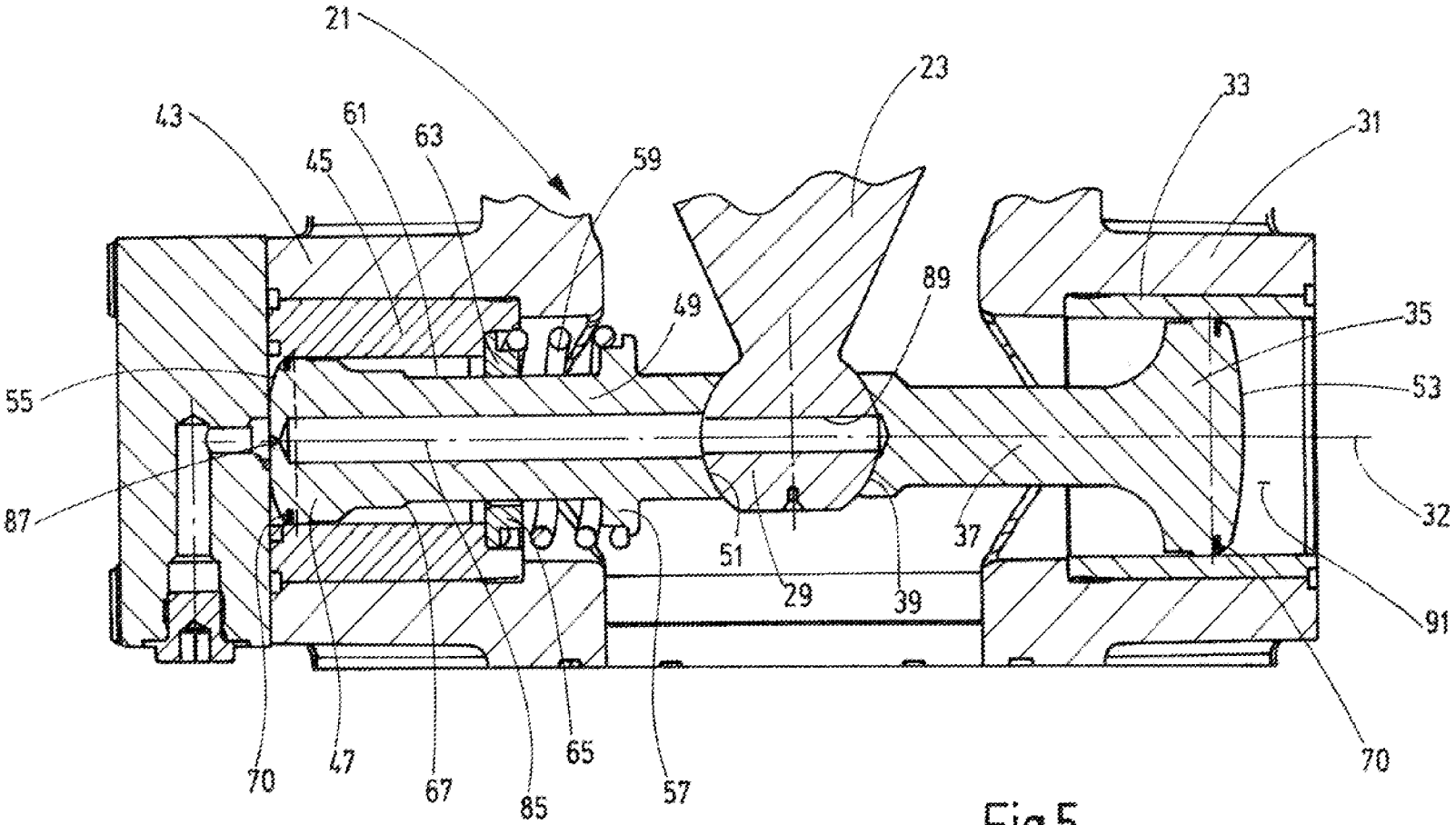
FIG. 5 is a partial and enlarged side view in section of the axial piston pump of FIGS. 3 and 4, wherein the adjustment device is shown in the operating state corresponding to zero delivery.

As shown in FIGS. 3 to 5, the adjustment device 21 has a first actuating cylinder 31 having a cylinder liner 33 defining a cylinder axis 32. In the cylinder liner 33, an actuating piston 35 is guided. The piston 35 is formed by a turned part, integral with its piston rod 37, and has a ball socket 39 at its free end. The ball socket 39 forms a ball joint by contacting the ball head 29, forming the articulation point of the swivel lever 23. Opposite from the first actuating cylinder 31 and located on the same cylinder axis 32 therewith, the adjustment device 21 has a second actuating cylinder 43 having a cylinder liner 45. A second actuating piston 47 is guided in the cylinder liner 45 and, like the first actuating piston 35, together with its piston rod 49 is formed by a one-piece turned part. Like the first actuating piston 35, the second actuating piston 47 has a ball socket 51 at the free end of its piston rod 49, which ball socket 51 forms a second ball joint by contacting the ball head 29 of the swivel lever 23. The pressurized piston area 53 of the first piston 35 is larger than the pressurized piston area 55 of the second actuating piston 47. A compression spring 59 is clamped between the cylinder liner 45 of the second actuating cylinder 43 and a spring plate 57, which is formed by a radially projecting collar of the piston rod 49 of the second actuating piston 47, The compression spring 59 pretensions the adjustment device 21 to the setting shown in FIG. 4, corresponding to the maximum pump delivery, and also keeps the ball joints formed at the ball head 29 of the swivel lever 23 free of play.

To keep the actuating pistons 35 and 37 free from constraining forces during the adjustment movements, in which the ball head 29 of the swivel lever 23 moves slightly away from the cylinder axis 32 at a vertical motion component, the invention provides a compensation means or compensator, which replaces the additional ball joint provided for this purpose in the state of the art and arranged in the respective actuating piston. In the present exemplary embodiment of the invention, the compensation means is formed by guide surfaces on the respective actuating piston 35, 47, which is integrally formed with its piston rod 37 or 49, and formed by a guide surface on the associated actuating cylinder 31, 43, more precisely, by its cylinder liner 33 or 45. In the embodiment shown, a special outer contour of the respective actuating piston 35, 47 is provided as a guide surface forming part of the compensation means. The corresponding design is explained with reference to FIGS. 6 to 8, which contain separate representations of the second actuating piston 47 that is integral with its piston rod 49. The circumferential profile shown in these figures, and in particular in FIG. 8, for the smaller actuating piston 47 corresponds fully to the circumferential profile of the larger actuating piston 35.

Figure 10:
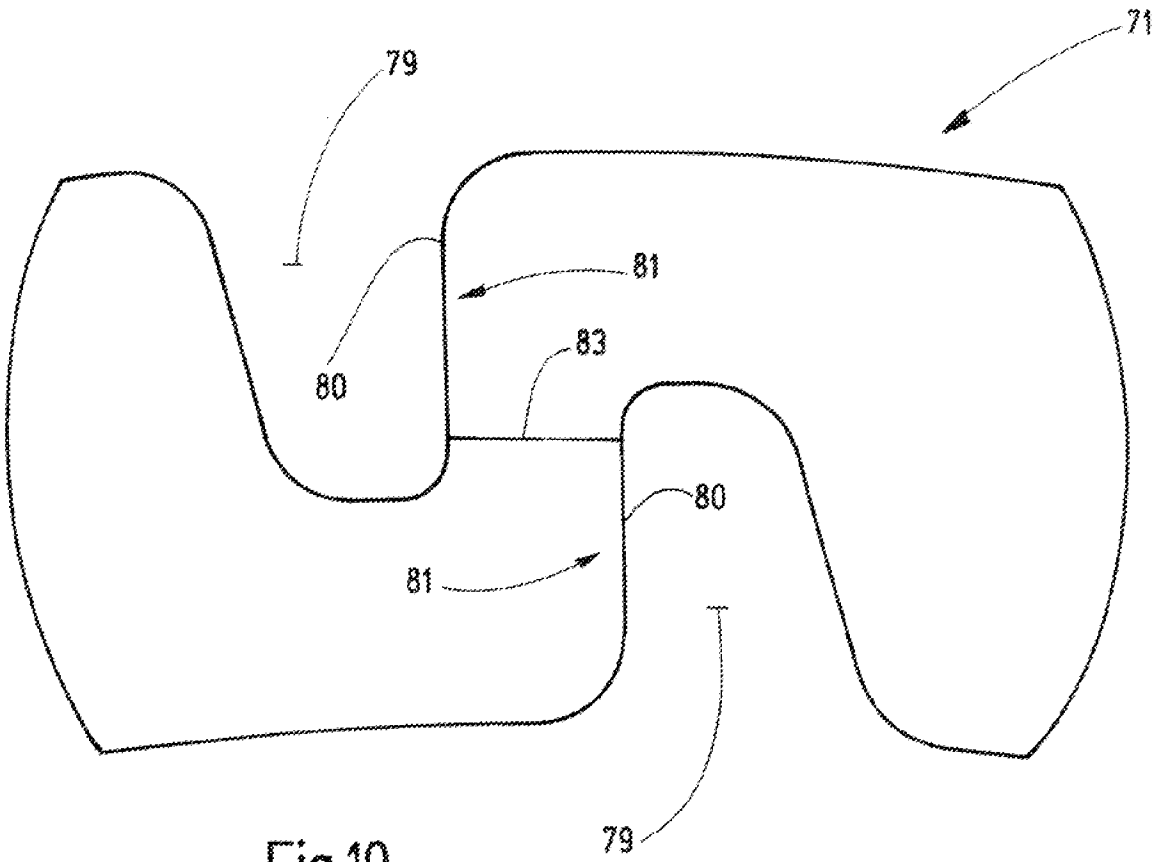
FIG. 10 is a partial and enlarged side view of the area, designated by Y in FIG. 9, of the separation point in the piston ring in a representation enlarged about 50 times compared to FIG. 9.
Figure 9:
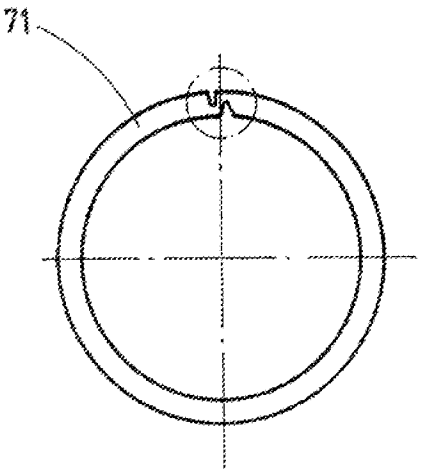
FIG. 9 is a side view of a piston ring on the actuating piston of the exemplary embodiment, having a separation point.

FIGS. 6 and 7 show the actuating piston 47 having the pressure spring 59 pre-mounted thereon, which rests on one side on the fixed spring plate 57 of the piston rod 49 and rests at the other end on a movable spring plate. The movable spring plate can be moved on the circular cylindrical outer surface 61 of the piston rod 49 and is composed of two ring halves 63 and 65. In the relaxed state of the compression spring 59, shown in FIGS. 6 and 7, the split movable spring plate 63, 65 is in contact with a step 67 of the piston rod 49. The design of the outer contour of the actuating pistons 35 and 47, which, as part of the compensation means permits a limited deflection motion of the axis of the piston rods 37, 49 from the cylinder axis 32, is only shown in more detail for the smaller piston 47 in FIG. 8 by way of example. As shown, near the front piston surface 55, a sealing zone 69 is formed by a piston ring pack 70, which is formed of three equally formed piston rings 71. One of the piston rings 71 is shown in FIGS. 9 and 10 in more detail. On the end facing away from the piston surface 55, a guide zone 73 adjoins to the piston rings 71 (see FIG. 8). The guide zone 73 is formed by a circumferential section 75, which forms the respective piston-sided guide surface and has a slight spherical curvature. The slight spherical curvature is selected such that the piston 47, even for a slight axial deviation, is guided in the respective cylinder liner 33, 45, which forms the cylinder-sided guide surface. Section 77, having a reduced outer circumference, in turn adjoins the section 75 (FIG. 8). The section 77 forms the transition to the circumferential sections, having a further reduced outer diameter, of the piston rod 49.

As illustrated in FIG. 8, the piston ring pack 70 is laterally offset in a longitudinal direction of the cylinder guide surface 33, 45 relative to a point of largest radial outward extension of the spherical guide surface 75 between the section 77 of reduced diameter and the piston ring pack 70 such that the piston ring pack 70 is laterally offset from a center of the spherical guide surface 75. The offset is in a direction away from the section 77 of reduced diameter.

FIGS. 9 and 10 show the construction of the piston rings 71. In FIG. 10 the open area, marked Y in FIG. 9, of the respective piston ring 71 is shown in more detail. As shown, this area is toothed in such a way that the piston ring 71 is elastically flexible, because there are free spaces 79 at the transition area of its ring ends 80. Within the free spaces 79, the two ring ends 80 can move against each other, as indicated by direction arrows 81, while sliding against each other at a separation point 83, which forms a sealing surface. For the lubricant supply of the ball joints formed from the ball head 29 and the ball sockets 39 and 51, a drilled hole 85 for lubricants is formed in the piston 47, which can be subjected to the system pressure, and continuous in the piston rod 49. The drilled hole 85, starting from a throttle point 87 located on the piston surface 55, leads to the ball socket 51, and from there continues via a drilled hole 89 in the ball head 29 to the ball socket 39 of the larger piston 35.

As mentioned, the pressure chamber 91 of the actuating cylinder 31 (FIGS. 3 and 5) can be pressurized with the control pressure actuating the adjustment device 21, while the pressure chamber 93 of the actuating cylinder 43 (FIG. 4) can be pressurized with the system pressure. FIG. 4 shows the setting to maximum delivery rate and no control pressure in pressure chamber 91 of the larger actuating piston 35. Due to the system pressure acting in the pressure chamber 93 of the smaller actuating piston 47 and the force of the compression spring 59, which rests on the cylinder liner 45 via the split spring plate 63, 65, the pistons 35 and 47 are shifted to the right in the drawing and the swivel lever 23 is swiveled out into the position shown in FIG. 4. To set the adjustment device 21 to a lower delivery rate, an appropriate control pressure is supplied to the pressure chamber 91 of the actuating cylinder 31. As soon as this exceeds the combined force resulting from the system pressure in the pressure chamber 93 of the smaller piston 47 and from the force of the compression spring 59, the pistons 35, 47 move to the left in the drawing such that the delivery rate can be reduced to zero delivery, as shown in FIGS. 3 and 5. The split spring plate 63, 65 has shifted on the cylindrical section 61 of the piston rod 49 and moved away from the step 67, with the compression spring 59 being compressed. Due to the action of the compression spring 59, the adjustment device is set to the maximum delivery rate, as shown in FIG. 4, even when the pump is at a standstill and there is no system pressure.

While one embodiment has been chosen to illustrate the invention, it will be understood by those skilled in the art that various changes and modifications can be made therein without departing from the scope of the invention as defined in the claims.

The invention claimed is:

1. A swash plate-type axial piston pump, comprising:

a pump housing;

a cylinder drum rotatable by a drive about an axis of rotation in the pump housing;

pistons arranged in and axially movable the cylinder drum, actuating ends of the pistons being accessible from outside of the cylinder drum;

a swash plate at least indirectly supporting the actuating ends of the pistons and setting strokes of the pistons generating fluid system pressure by axial movement of the pistons;

an adjustor being coupled to and swiveling the swash plate to a desired angle of inclination relative to the axis of rotation, the adjustor having a swiveling lever that can be deflected and returned in at least one direction by an actuator, the actuator having a hydraulically actuated first actuating cylinder and a first actuating piston in the first actuating cylinder, the first actuating piston having a first end thereof acting on an articulation point of the swivel lever and a second end facing away from the articulation point;

a guide surface being an integral part of the first actuating piston and being in contact with an assigned guide surface of the first actuating cylinder;

a first compensator orienting the guide surfaces in respective positions thereof relative to each other; and a sealing zone being on the first actuating piston adjacent the second end thereof and being formed by a piston ring pack and only a single guide zone adjoining the piston ring pack, the guide zone forming a spherical guide surface resting against a cylinder guide surface of the first actuating cylinder and forming the first compensator, a section of reduced diameter on the first actuating piston forming a transition to a piston rod of the first actuating piston adjoining the guide zone, the piston ring pack being laterally offset in a longitudinal direction of the cylinder guide surface relative to a point of largest radial outward extension of the spherical guide surface between the section of reduced diameter and the piston ring pack such that the piston ring pack is laterally offset from a center of the spherical guide surface.

2. The axial piston pump according to claim 1 wherein the piston ring pack comprises three equally formed piston rings.

3. The axial piston pump according to claim 1 wherein the compensator comprises at least one of a compression spring arrangement or a lubricant supply.

4. The axial piston pump according to claim 1 wherein the actuator comprises a hydraulically actuated second actuating cylinder and a second actuating piston in the second actuating cylinder, the second actuating piston having a first end thereof acting on the articulation point of the swivel lever and a second end facing away from the articulation point, the second actuating pistons having a second compensator.

5. The axial piston pump according to claim 4 wherein a free end face of the second end of the first actuating piston is connected to a system pressure side, and a free end face of the second end of the second actuating piston is connected to a control pressure side, forming a part of an actuator for the adjustor.

6. The axial piston pump according to claim 4 wherein the compensator comprises a lubricant supply having a longitudinal channel through the first actuating piston and a further channel in the articulation point of the swivel lever.

7. The axial piston pump according to claim 4 wherein a sealing zone is on the second actuating piston adjacent the second end thereof and being formed by a piston ring pack of at least two equally formed piston rings and only a single guide zone adjoining the piston ring pack thereof, the guide zone of the second actuating piston forming a spherical guide surface resting against a cylinder guide surface of the second actuating cylinder and forming the second compensator of the second actuating piston, a section of reduced diameter on the second actuating piston forming a transition to a piston rod of the second actuating piston adjoining the guide zone of the second actuating piston, each of the piston rings on the second actuating piston having two ring ends forming a separation point therebetween such that each of the piston rings on the second actuating piston is elastically flexible.

8. The axial piston pump according to claim 1 wherein the articulation point is formed by a ball joint having a ball head formed at a free end of the swivel lever and a ball socket formed on the first end of the first actuating piston, a spring biasing the ball head and the ball socket in a force-fitted contact with each other.

9. The axial piston pump according to claim 8 wherein the spring pre-loads the swash plate in a swivel position corresponding to maximum pump delivery.

10. The axial piston pump according to claim 1 wherein the swivel lever extends laterally of the swash plate and of the cylinder drum in parallel to the axis of rotation when set to a zero pump delivery position and has a ball joint at a free end of the swivel lever.

11. The axial piston pump according to claim 4 wherein the second actuating cylinder has a joint cylinder axis perpendicular to the axis of rotation and is arranged opposite from the first actuating cylinder, the second actuating piston in the second actuating cylinder being hydraulically movable for contrary motion of the switching lever, the second compensator being between the second actuating cylinder and a piston rod of the second actuating piston by a guide zone forming a spherical guide surface on the second actuating piston in the second actuating cylinder, an end of a piston rod of the second actuating cylinder forming a second ball joint at the articulation point.

12. The axial piston pump according to claim 4 wherein a compression spring preloads a piston rod of the second actuating piston in a direction corresponding to an extension of the second actuating piston in the second actuating cylinder and a retraction of the first actuating piston in the first actuating cylinder and swiveling of the swivel lever from a direction parallel to the axis of rotation towards a position of maximum pump delivery.

13. The axial piston pump according to claim 5 wherein the free end face of the second actuating piston is pressurized by a control pressure and is larger in area than an area of the free end face of the first actuating piston area.

14. The axial piston pump according to claim 5 wherein the second actuating piston, adjacent to the free end face thereof, has a sealing zone formed by a piston ring pack of at least two equally formed piston rings.

15. The axial piston pump according to claim 5 wherein the second actuating piston, adjacent to the free end face thereof, has a sealing zone formed by a piston ring pack of at least three equally formed piston rings.

16. The axial piston pump according to claim 5 wherein the second actuating piston, adjacent to the free end face thereof, has a sealing zone formed by at least one piston ring being elastically flexible due to a free space at a transition area of two ring ends thereof, within the free space the two ring ends being movable relative to one another.

17. The axial piston pump according to claim 1 wherein the spherical guide surface is only on one axial side of the first actuating piston.

18. The axial piston pump according to claim 17 wherein the one axial side of the first actuating piston is adjacent a piston rod of the first actuating piston.

19. The axial piston pump according to claim 17 wherein a recess extends radially inwardly in the first actuating piston on an axial side of the piston ring pack opposite the spherical guide surface.

20. The axial piston pump according to claim 1 wherein the first actuating piston has a piston rod fixedly attached thereto as a one-piece combination.

21. The axial piston pump according to claim 1 wherein the piston ring pack of at least two equally formed piston rings.

22. The axial piston pump according to claim 21 wherein each of the piston rings having two ring ends forming a separation point therebetween such that each of the piston rings is elastically flexible.

23. The axial piston pump according to claim 1 wherein the piston ring pack is laterally offset in a direction away from the section of reduced diameter.

* * * * *